US007399200B1

(12) United States Patent
Eliseo

(10) Patent No.: US 7,399,200 B1
(45) Date of Patent: Jul. 15, 2008

(54) APPARATUS FOR CONCEALING AN AC POWER STRIP AND ORGANIZING POWER CORDS CONNECTED THERETO

(76) Inventor: Jeffrey Mark Eliseo, 4470 Plantation Dr., Fair Oaks, CA (US) 95628

( * ) Notice: Subject to any disclaimer, the term of this patent is extended or adjusted under 35 U.S.C. 154(b) by 152 days.

(21) Appl. No.: 11/518,475

(22) Filed: Sep. 7, 2006

(51) Int. Cl.
*H01R 13/60* (2006.01)

(52) U.S. Cl. ..... 439/501; 439/535; 439/577; 439/652

(58) Field of Classification Search ..... 439/501, 439/577, 535, 652
See application file for complete search history.

(56) References Cited

U.S. PATENT DOCUMENTS 6,805,581 B2 * 10/2004 Love ..... 439/535
7,001,211 B2 * 2/2006 Lichtscheidl et al. ..... 439/501
7,004,786 B1 * 2/2006 Bloom et al. ..... 439/501
2005/0130492 A1 * 6/2005 Noh ..... 439/501
2005/0176290 A1 * 8/2005 Lichtscheidl et al. ..... 439/501
2006/0141855 A1 * 6/2006 Bloom et al. ..... 439/501

* cited by examiner

*Primary Examiner*—Gary F. Paumen
(74) *Attorney, Agent, or Firm*—Douglas E. MacKenzie

(57) ABSTRACT

An apparatus for concealing an AC power strip and organizing power cords connected thereto includes a top section; a middle section comprising a bottom portion and a top portion, the top portion including an AC power strip receiving section, the bottom portion including at least one slot formed on a top rim thereof, the slot sized and configured to allow passage of the power cords; a bottom section, the bottom section being attachable to the middle section. The top section is slidingly and frictionally attachable to the middle section and the top section, middle section and bottom section provide an enclosure therewithin in a closed configuration for concealing the AC power strip and connected power cords.

20 Claims, 5 Drawing Sheets

APPARATUS FOR CONCEALING AN AC POWER STRIP AND ORGANIZING POWER CORDS CONNECTED THERETO

FIELD OF THE INVENTION

The present invention relates generally to apparatus for concealing cords, cables and power outlets and more particularly to an apparatus for concealing an AC power strip and organizing power cords connected thereto.

BACKGROUND OF THE INVENTION

Electronic equipment, such as office equipment and audio/visual equipment in use in both home and office settings, typically includes at least a power cord and several signal cords. To locate electronic equipment in an area of a home or office away from a wall power receptacle, an AC power strip is conventionally used to provide power to each of a plurality of electronic devices such as a personal computer, a monitor, a printer, a telephone, and a facsimile machine. The AC power strip may be located on a floor proximate the electronic devices with the power cords of the connected electronic devices running from the AC power strip along the floor and elsewhere to power the electronic devices.

This arrangement of power cords and the AC power strip typically results in the AC power strip and the connected power cords being disposed in an unsafe and unsightly manner with excess sections of cord creating "rat's nests" of cords. In cases where the AC power strip and the connected power cords are concealed, the AC power strip and power cords are oftentimes disposed under or behind desks and other furniture making access to the AC power strip and power cords difficult.

Various solutions to the problem of managing electronic device cords, and more particularly, electronic device power cords and associated sources of AC power have been proposed in the prior art. U.S. Pat. No. D411,177 entitled "Housing for Mounting, Arranging and Securing Electrical Power Lines to a Computer" shows a wire open mesh basket having a plurality of brackets attached to inside and outside portions of the basket for wrapping and securing power cords therearound. A power strip is shown attached to the outside portion the mesh basket. However, this basket does not provide for concealment of either the power strip or the power cords.

Another solution is shown in U.S. Pat. No. D445,766 entitled "Housing for Mounting, Arranging and Securing Electrical Power Lines to a Computer". A wire open mesh basket includes a hinged lid and a plurality of brackets attached to inside portions of the basket. A power strip is shown attached to the inside portion of the basket. However, this basket does not provide for concealment of either the power strip or the power cords.

Other solutions include U.S. Pat. No. 5,596,479 entitled "Power Surge Protector", U.S. Pat. No. 5,924,892 entitled "Device for Electrically Powering a Plurality of User Items Provided With Their Own Electrical Feed and Data Transfer Cables, to at Least Partially Contain These Cables During Said Feed", U.S. Pat. No. 6,017,228 entitled "Electrical Station", U.S. Patent Application Publication No. 2005/0130492 A1 entitled "Receptacle Having Electric Power Cord Box Installed Therein" and U.S. Patent Application Publication No. 2005/0164545 entitled "Apparatus for Connecting and Organizing Cords and Cables". These solutions generally provide for a plurality of power receptacles and a space for storing excess lengths of power cords connected to the receptacles. However, these solutions do not provide for a means of concealing an AC power strip and connected power cords.

There is therefore a need in the art for an apparatus for concealing and AC power strip and organizing power cords connected thereto that overcomes the disadvantages of the prior art. There is also a need for an apparatus that provides space for storing excess lengths of power cords connected to the concealed AC power strip. There is a further need for an apparatus that is compact and easy to use.

SUMMARY OF THE INVENTION

The present invention provides an apparatus for receiving an AC power strip and power cords connected thereto. A top section, a middle section, and a bottom section provide an enclosure for receiving the AC power strip and the connected power cords. The AC power strip is receivable in the middle section with the top section providing a means of access to the AC power strip and the power cords disposed in the enclosure.

In accordance with one aspect of the invention, an apparatus for concealing an AC power strip and organizing power cords connected thereto includes a top section; a middle section comprising a bottom portion and a top portion, the top portion including an AC power strip receiving section, the bottom portion including at least one slot formed on a top rim thereof, the slot sized and configured to allow passage of the power cords; a bottom section, the bottom section being attachable to the middle section; and wherein the top section is slidingly and frictionally attachable to the middle section and wherein the top section, middle section and bottom section provide an enclosure therewithin in a closed configuration.

In accordance with another aspect of the invention, an apparatus for concealing an AC power strip and organizing power cords connected thereto includes a top section comprising front, back, top and side portions, the front, back, top and side portions providing a partial enclosure therewithin; a middle section comprising a bottom portion and a top portion, the top portion including an AC power strip receiving section disposed between a pair of rectangular columnar portions, the bottom portion including at least one slot formed on a top rim thereof, the slot sized and configured to allow passage of the power cords; a bottom section comprising a bottom portion and a rim portion, the rim portion including an aperture formed therethrough, the bottom section being attachable to the middle section; and wherein the top section is slidingly and frictionally attachable to the middle section and wherein the top section, middle section and bottom section provide an enclosure in a closed configuration, the enclosure concealing the AC power strip and connected power cords therewithin.

In accordance with yet another aspect of the invention, an apparatus for concealing an AC power strip and organizing power cords connected thereto includes a top section comprising a partial enclosure; a middle section comprising an AC power strip receiving section and at least one slot sized and configured to allow passage of the power cords; a bottom section, the bottom section being attachable to the middle section; and wherein the top section is slidingly and frictionally attachable to the middle section and wherein the top section, middle section and bottom section provide an enclosure therewithin in a closed configuration for concealing the AC power strip and power cords connected thereto.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of components and to the arrangements of these components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings.

DETAILED DESCRIPTION OF THE INVENTION

Figure 1:
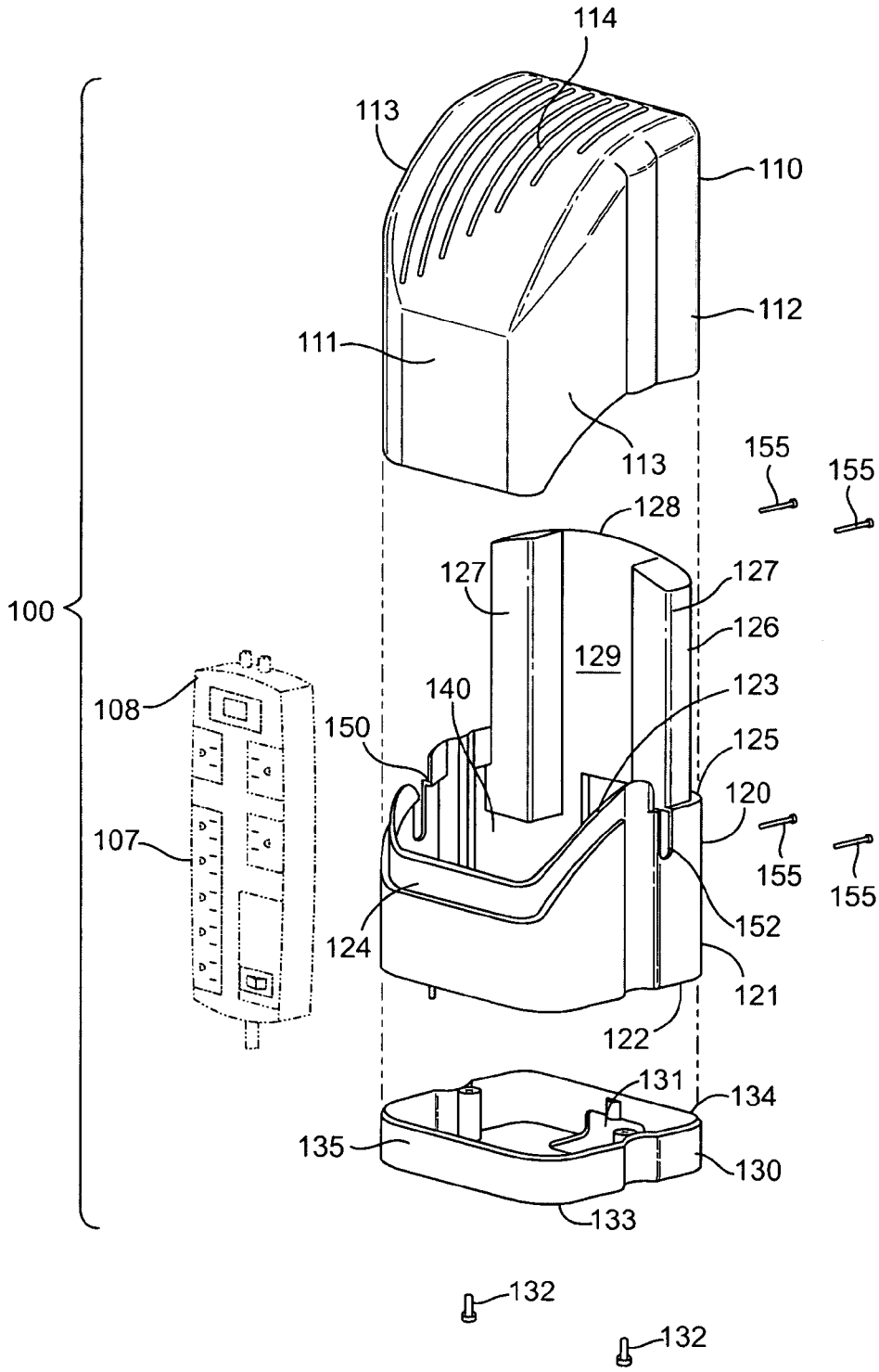
FIG. 1 is an exploded view of an apparatus for concealing an AC power strip and organizing power cords connected thereto in accordance with the invention.
Figure 2:
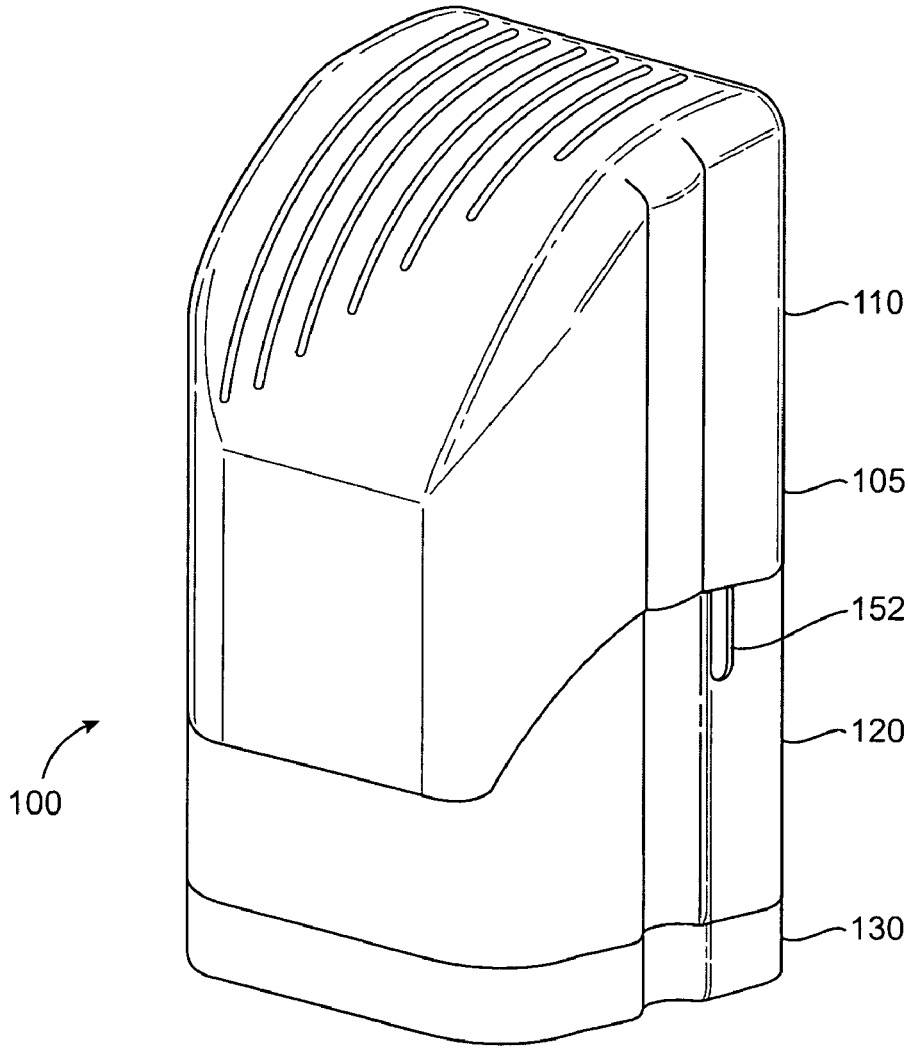
FIG. 2 is a perspective view of the apparatus of FIG. 1 in accordance with the invention.
Figure 3:
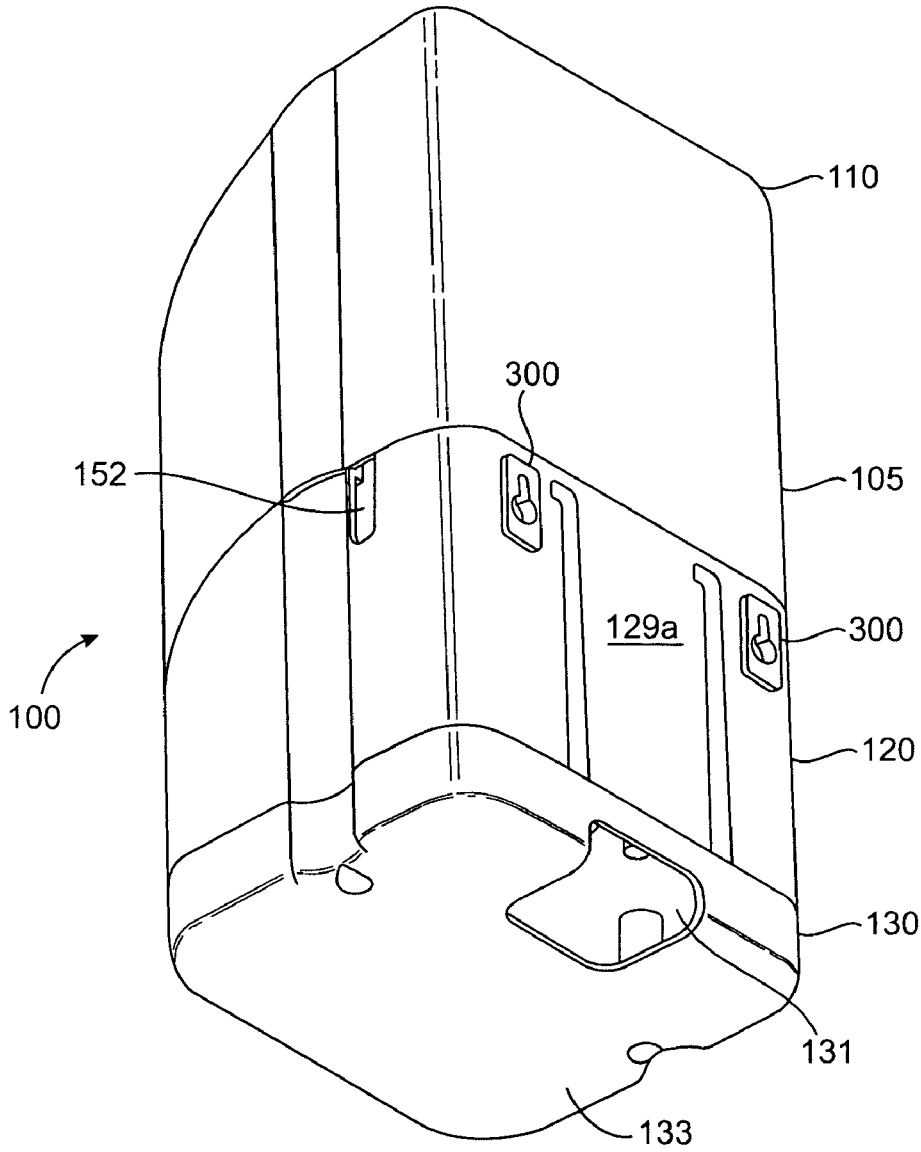
FIG. 3 is a bottom perspective view of the apparatus of FIG. 1 in accordance with the invention.
Figure 5:
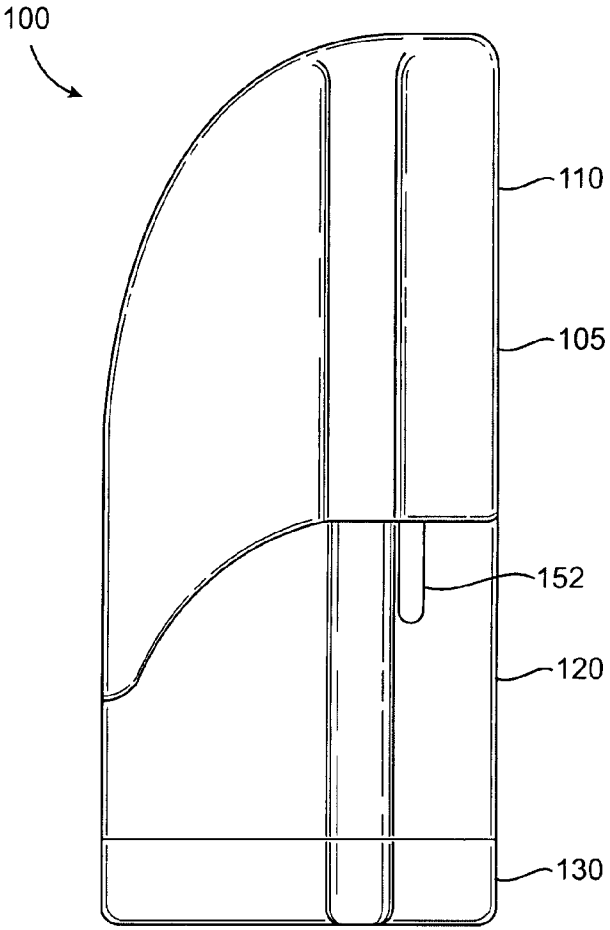
FIG. 5 is a right side elevation view of the apparatus in FIG. 1 in accordance with the invention.
Figure 4:
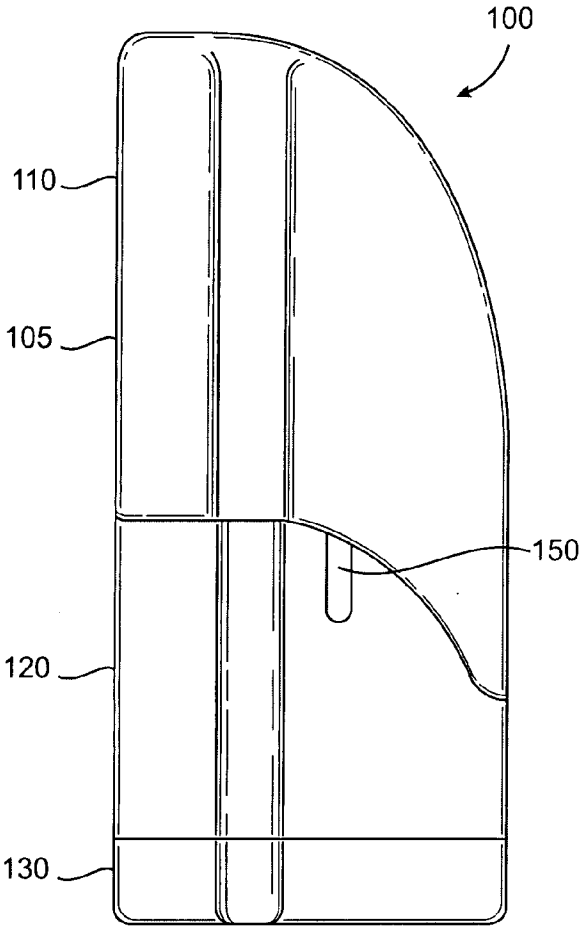
FIG. 4 is a left side elevation view of the apparatus of FIG. 1 in accordance with the invention.

In one aspect of the invention, and with reference to the FIGS. 1-6, an apparatus generally designated 100 for concealing an AC power strip and organizing power cords connected thereto includes a housing 105 having a top section 110, a middle section 120, and a bottom section 130. Top section 110, middle section 120, and bottom section 130 are sized and designed to form an enclosure 140 therewithin in a closed configuration. The enclosure 140 provides a space within the apparatus 100 that can receive an AC power strip 107 and power cords 109 connected thereto. Housing 105 may be formed of suitable materials including plastics and metals.

Middle section 120 may be of unitary construction and comprise a bottom portion 121 of generally rectangular cross section having various ornamental features including rounded corners. Bottom portion 121 includes a bottom rim 122 and a top rim 123. Top rim 123 includes a front portion 124 sized and configured to receive a front portion 111 of the top section 110 and a back portion 125 that provides a stop to a back portion 112 of the top section 110 in the closed configuration.

The top rim 123 of the bottom portion 121 further includes a first slot 150 and a second slot 152. Slots 150 and 152 are preferably disposed on opposite sides of the top rim 123 and are sized and configured to provide apertures through which power cords 109 may exit the apparatus 100.

Figure 6:
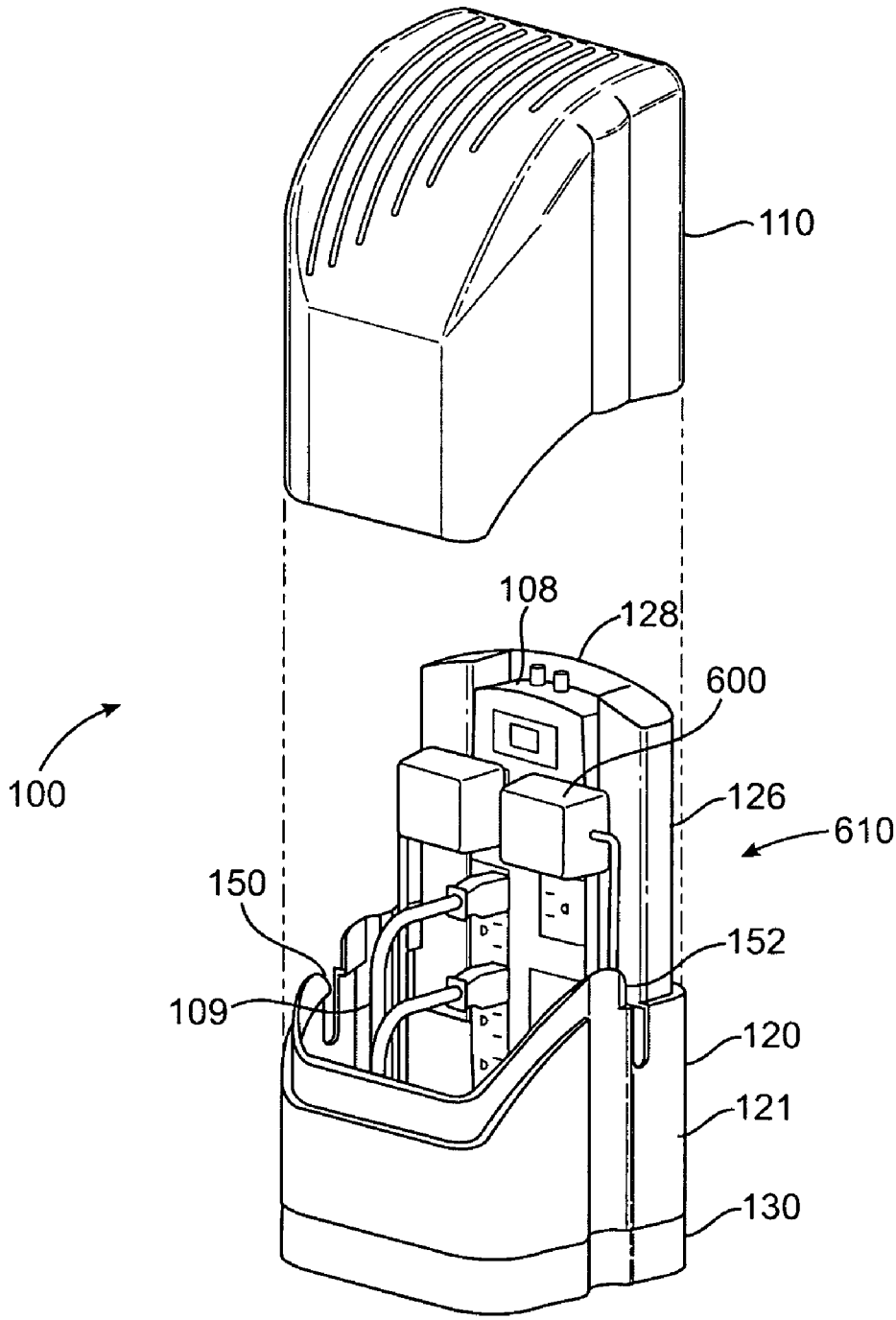
FIG. 6 is a perspective view showing the top detached from the bottom of the apparatus of FIG. 1 in accordance with the invention.

Middle section 120 further comprises a top portion 126 extending from the back portion 125 of the top rim 123 of the bottom portion 121 thereof. Top portion 126 includes a pair of spaced apart generally rectangular columnar portions 127 defining an AC power strip receiving section 129 therebetween. As shown in FIG. 6, the AC power strip 107 may be closely received between the columnar portions 127, the columnar portions 127 being of roughly the same lateral dimension as that of the AC power strip 107. This enables the easy use of DC adapters 600 as shown. Those skilled in the art will recognize that the novel apparatus 100 could include a single rectangular columnar portion 127 to provide an enclosure 140 of smaller dimensions. The AC power strip 107 may be attached to the receiving section 129 using conventional attachment means including glue, tape, and screws.

With continued reference to FIG. 6, the AC power strip 107 is shown received between the columnar portions 127 such that a top 108 thereof is oriented toward a top edge 128 of the top portion 126. The AC power strip 107 may be fixed in the receiving section 129 by any conventional means including using adhesive tape, hook and eye systems such as Velcro®, and screws 155 (FIG. 1). The power cord of the AC power strip (not shown) exits the apparatus 100 through a rectangular aperture 131 formed in the bottom section 130. Some of the power cords 109 attached to the AC power strip 107 may also exit the apparatus 100 through the rectangular aperture 131.

Middle section 120 also comprises a pair of means 300 (FIG. 3) for attaching the apparatus 100 to vertical and horizontal surfaces such as walls and furniture components. Means 300 are preferably formed on a back surface 129*a* of the middle section 120. Means 300 may include tabs having screw head receiving apertures as shown, adhesive tape and a system of hooks and loops such as Velcro®.

Top section front portion 111, back portion 112, top portion 114, and side portions 113 define an enclosure therein (not shown). Top section 110 is slidingly and frictionally receivable over the middle section 120. Front portion 111 is slidingly and frictionally receivable by the front portion 124 of the top rim 123 and the back portion 112 is slidingly and frictionally receivable over the top portion 126 of the middle section 120. Back portion 125 of the top rim 123 provides a stop to the back portion 112 of the top section 110 to thereby position the top section 110 on the middle section 120.

The bottom section 130 comprises a bottom portion 133 and a rim portion 135. Rectangular aperture 131 may be formed so as to span a portion of the bottom portion 133 and the rim portion 135. The rim portion 135 includes a top rim 134 sized and configured to slidingly and frictionally receive the bottom rim 122 of the middle section 120. For ease of use the bottom section 130 may be screwed to the middle section 120 using screws 132 to form an enclosure bottom portion generally designated 610 in FIG. 6. In an alternative embodiment, the middle section 120 and the bottom section 130 may be of unitary construction.

The apparatus 100 for concealing an AC power strip and power cords connected thereto of the invention provides an inexpensive and easy to use apparatus which can be used with existing AC power strips. By providing a means for mounting an existing AC power strip inside the housing 105, consumers do not have to purchase expensive devices having AC receptacles. The AC power strip and excess portions of connected power cords can be easily concealed and stored within the apparatus 100 to provide for safe management of the AC power strip and connected power cords.

It should be understood, of course, that the foregoing relates to preferred embodiments of the invention and that modifications may be made without departing from the spirit and scope of the invention as set forth in the following claims.

The invention claimed is:

1. An apparatus for concealing an AC power strip and organizing power cords connected thereto comprising:

a top section;

a middle section comprising a bottom portion and a top portion, the top portion including an AC power strip receiving section, the bottom portion including at least one slot formed on a top rim thereof, the slot sized and configured to allow passage of the power cords;

a bottom section, the bottom section being attachable to the middle section; and wherein the top section is slidingly and frictionally attachable to the middle section and wherein the top section, middle section and bottom section provide an enclosure therewithin in a closed configuration.

2. The apparatus of claim 1, wherein the bottom section comprises an aperture for receiving a power cord of the AC power strip.

3. The apparatus of claim 2, wherein the bottom section comprises a bottom portion and a rim portion, the aperture spanning a portion of the bottom portion and a portion of the rim portion.

4. The apparatus of claim 1, wherein the bottom section comprises a rim portion, the rim portion being sized and configured to slidingly and frictionally receive a middle section bottom rim.

5. The apparatus of claim 1, wherein the top section comprises front, back, top and side portions defining a top section partial enclosure therewithin.

6. The apparatus of claim 1, wherein the middle section top portion comprises at least one columnar portion, the AC power strip receiving section being disposed adjacent the at least one columnar portion.

7. The apparatus of claim 1, wherein the middle section top portion comprises two spaced apart columnar portions, the AC power strip receiving section being disposed between the columnar portions.

8. The apparatus of claim 1, wherein the middle section bottom portion comprises a bottom rim, the middle section bottom rim being slidingly and frictionally attachable to a bottom section top rim.

9. The apparatus of claim 1, wherein the middle section bottom portion comprises a top rim, the middle section top rim including a front portion and a back portion, the front portion being sized and configured to receive a top section front portion and the back portion providing a stop to a top section back portion in a closed configuration.

10. An apparatus for concealing an AC power strip and organizing power cords connected thereto comprising:

a top section comprising front, back, top and side portions, the front, back, top and side portions providing a partial enclosure therewithin;

a middle section comprising a bottom portion and a top portion, the top portion including an AC power strip receiving section disposed between a pair of rectangular columnar portions, the bottom portion including at least one slot formed on a top rim thereof, the slot sized and configured to allow passage of the power cords;

a bottom section comprising a bottom portion and a rim portion, the rim portion including an aperture formed therethrough, the bottom section being attachable to the middle section; and wherein the top section is slidingly and frictionally attachable to the middle section and wherein the top section, middle section and bottom section provide an enclosure in a closed configuration, the enclosure concealing the AC power strip and connected power cords therewithin.

11. The apparatus of claim 10, wherein the bottom section rim portion aperture is sized and configured to receive a power cord of the AC power strip therethrough.

12. The apparatus of claim 10, wherein the bottom section rim portion is sized and configured to slidingly and frictionally receive a middle section bottom rim.

13. The apparatus of claim 10, wherein the middle section bottom portion comprises a bottom rim, the middle section bottom rim being slidingly and frictionally attachable to the bottom section rim portion.

14. An apparatus for concealing an AC power strip and organizing power cords connected thereto comprising:

a top section comprising a partial enclosure;

a middle section comprising an AC power strip receiving section and at least one slot sized and configured to allow passage of the power cords;

a bottom section, the bottom section being attachable to the middle section; and wherein the top section is slidingly and frictionally attachable to the middle section and wherein the top section, middle section and bottom section provide an enclosure therewithin in a closed configuration for concealing the AC power strip and power cords connected thereto.

15. The apparatus of claim 14, wherein the top section comprises front, back, top and side portions, the front, back, top and side portions providing the partial enclosure therewithin.

16. The apparatus of claim 14, wherein the middle section comprises a bottom portion and a top portion, the top portion including the AC power strip receiving section disposed between at least one columnar portion, the bottom portion including the at least one slot formed on a top rim thereof.

17. The apparatus of claim 14, wherein the bottom section comprises a bottom portion and a rim portion, the rim portion including an aperture formed therethrough, the aperture sized and configured to receive an AC power strip power cord.

18. The apparatus of claim 14, wherein a bottom section rim portion is sized and configured to slidingly and frictionally receive a middle section bottom rim.

19. The apparatus of claim 14, wherein the middle section comprises a bottom portion including a bottom rim, the middle section bottom rim being slidingly and frictionally attachable to a bottom section rim portion.

20. The apparatus of claim 14, wherein the middle section comprises a top portion including two spaced apart columnar portions, the AC power strip receiving section being disposed between the columnar portions.

* * * * *